US012569053B2

(12) United States Patent
Cigard et al.

(10) Patent No.: US 12,569,053 B2
(45) Date of Patent: Mar. 10, 2026

(54) ATTACHMENT PANEL FOR A MODULAR ATTACHMENT GRID

(71) Applicant: Blue Force Gear, Inc., Pooler, GA (US)

(72) Inventors: Tyler Aaron Cigard, Rincon, GA (US); Stephen Glenn Hilliard, Cainhoy, SC (US)

(73) Assignee: Blue Force Gear, Inc., Pooler, GA (US)

( * ) Notice: Subject to any disclaimer, the term of this patent is extended or adjusted under 35 U.S.C. 154(b) by 83 days.

(21) Appl. No.: 18/661,138

(22) Filed: May 10, 2024

(65) Prior Publication Data

US 2024/0374019 A1 Nov. 14, 2024

Related U.S. Application Data

(60) Provisional application No. 63/501,343, filed on May 10, 2023.

(51) Int. Cl.
*A45F 5/02* (2006.01)

(52) U.S. Cl.
CPC ..... *A45F 5/02* (2013.01)

(58) Field of Classification Search
CPC ..... A45F 5/02
USPC ..... 224/663, 682, 681, 680
See application file for complete search history.

(56) References Cited

U.S. PATENT DOCUMENTS

| | | | | | |
|---|---|---|---|---|---|
| 5,370,288 | A * | 12/1994 | Field | A45C 13/02 | 224/256 |
| 5,724,707 | A * | 3/1998 | Kirk | A45F 5/02 | 224/675 |
| 6,431,420 | B1 * | 8/2002 | Cragg | A45F 5/00 | 224/684 |
| 7,559,445 | B1 * | 7/2009 | Kulp | F42B 39/02 | 224/684 |
| 7,694,862 | B2 * | 4/2010 | Bergeron | A45F 5/02 | 224/675 |
| 7,963,427 | B2 * | 6/2011 | Calkin | A41D 13/0012 | 224/675 |
| 8,002,159 | B2 * | 8/2011 | Cragg | A45F 5/02 | 224/675 |
| 8,079,503 | B1 * | 12/2011 | Yeates | A45C 7/0086 | 224/268 |
| 8,453,899 | B1 * | 6/2013 | Calkin | A45F 3/04 | 224/675 |
| 8,720,762 | B2 * | 5/2014 | Hilliard | F41C 33/0218 | 224/675 |
| 9,144,255 | B1 * | 9/2015 | Perciballi | A41D 27/00 | |
| 9,469,440 | B1 * | 10/2016 | Flood | A45C 13/008 | |
| 9,565,922 | B2 * | 2/2017 | Cole | A45F 5/02 | |
| 10,264,874 | B2 * | 4/2019 | Becker | A45F 3/14 | |
| 12,088,244 | B2 * | 9/2024 | Thiel | A45F 5/1533 | |
| 12,150,540 | B2 * | 11/2024 | Sarlin | A41D 13/0007 | |
| 2007/0235484 | A1 * | 10/2007 | Staniszewski | B60R 11/00 | 224/312 |

(Continued)

*Primary Examiner* — Nathan J Newhouse
*Assistant Examiner* — Lester L Vanterpool
(74) *Attorney, Agent, or Firm* — Eversheds Sutherland (US) LLP

(57) ABSTRACT

The present disclosure relates to an attachable panel attachable to a modular attachment grid in either a first or second configuration to hold equipment in different orientations and configurations.

14 Claims, 7 Drawing Sheets

(56) References Cited

U.S. PATENT DOCUMENTS

| | | | | |
|---|---|---|---|---|
| 2010/0025560 | A1* | 2/2010 | Beck | A45F 5/02 248/558 |
| 2010/0176174 | A1* | 7/2010 | Felts | F42B 39/02 224/676 |
| 2013/0126566 | A1* | 5/2013 | Seuk | A45F 5/00 224/223 |
| 2015/0189977 | A1* | 7/2015 | Thompson | A45F 5/02 24/3.7 |
| 2016/0029777 | A1* | 2/2016 | Gadams | A45F 5/00 224/222 |
| 2016/0313105 | A1* | 10/2016 | Olroyd | F42B 39/02 |
| 2024/0130512 | A1* | 4/2024 | Mironski | A45F 5/02 |

* cited by examiner

ATTACHMENT PANEL FOR A MODULAR ATTACHMENT GRID

REFERENCE TO RELATED APPLICATION

This application claims the benefit of U.S. Provisional Patent Application No. 63/501,343, filed on May 10, 2023, the disclosure of which is incorporated herein by reference in its entirety.

TECHNICAL FIELD

This disclosure relates generally to modular attachment panels, and more particularly to the mounting of modular attachments in different configurations and orientations.

BACKGROUND

Users (including consumers, law enforcement and military specialists) may carry a large amount of equipment on their person. This may lead to constraints on their load carriage equipment and limiting their space, orientation, and configuration options. As such, standard modular attachment grids and standard attachment panels may not provide adaptability in holding equipment.

SUMMARY

The present disclosure relates to a multi-oriented attachment panel receivable by a modular attachment grid. The attachment panel includes a base defining a first surface, a second surface. The panel may further include a plurality of first straps on a first side of attachment panel and a plurality of second straps on a side of attachment panel. Further, the panel may include an object retention arrangement configured to hold objects on the first surface of the attachment panel. Each of the plurality of first straps and the plurality of second straps include an attachment end. The plurality of first straps are configured to attach the attachment panel to the modular attachment grid in a first configuration. The plurality of second straps are configured to attach the attachment panel to the modular attachment grid in a second configuration.

Another aspect of the present disclosure relates to an apparatus comprising an attachment surface comprising a modular attachment grid and an attachment panel configured to be received by a modular attachment grid. The attachment panel includes a base defining a first surface, a second surface. The panel may further include a plurality of first straps on a first side of attachment panel and a plurality of second straps on a side of attachment panel. Further, the panel may include an object retention arrangement configured to hold objects on the first surface of the attachment panel. Each of the plurality of first straps and the plurality of second straps include an attachment end. The plurality of first straps are configured to attach the attachment panel to the modular attachment grid in a first configuration. The plurality of second straps are configured to attach the attachment panel to the modular attachment grid in a second configuration.

DETAILED DESCRIPTION

One aspect of the present disclosure relates to the attachment of an attachment panel to modular lightweight load carrying equipment in a first and second configuration. Attachment panels may carry tools or equipment in pouches, which may be easier to access based on the tool and the orientation of the tool on the attachment panel. By changing the orientation of the attachment panel when connecting to a modular attachment grid, the orientation of the tool can be adjusted to be more accessible to a user.

Another aspect of the present disclosure relates to allowing different attachment panels to be attached to modular attachment grid with the ability to change between the first and second configuration. U.S military, consumers, or law enforcement may require and/or desire load carrying equipment to hold different tools in different configurations and situations. Different attachment panels may include features that allow the holding of different tools and items. For instance, in some cases a user may desire to hold shotshells. In other instances, the tools could be a medical kit.

A modular attachment grid refers to a Modular Lightweight Load Equipment ("MOLLE") grid surface. Modular attachment grids may be part of a variety of different load carrying equipment. As non-limiting examples, vests, backpacks, belts, and chest rigs may include the modular attachment grid. However, any modular attachment grid may receive the attachable equipment attachment panel.

Figure 1:
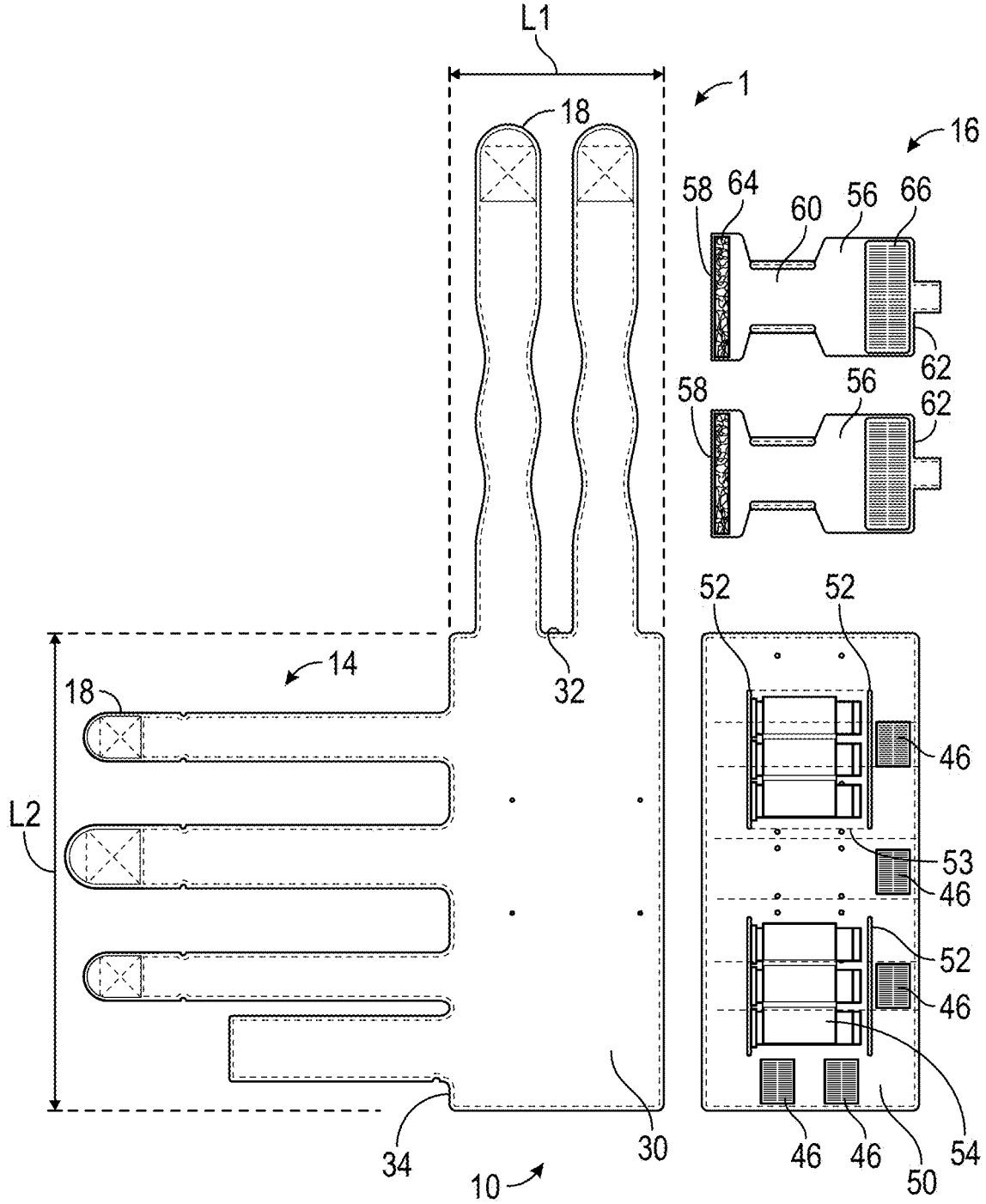
FIG. 1 is an exploded perspective view of the attachment panel of the present disclosure.

FIG. 1 illustrates an attachment panel 1 for holding equipment of the present disclosure mountable in different configurations. The attachment panel 1 comprises a base 10 configured to be connected to a modular attachment grid 100 (shown in FIG. 2) in a first configuration (shown in FIG. 2) or a second configuration (shown in FIG. 3), a plurality of first straps 12, and a plurality of second straps 14, and an object retention arrangement 16. Each of the plurality of first straps 12 and the plurality of second straps 14 include attachment ends 18.

The attachment panel 1 is designed to allow the attachment of equipment to the attachment panel 1. The attachment panel 1 is able to be joined to a modular attachment grid 100 of an attachment surface. When placed in the first or second configuration, the attachment panel 1 attaches objects to the modular attachment grid in different orientations.

The base 10 includes a first surface 30, a second surface 31 (shown in FIG. 4), a first side 32, and a second side 34. When attached, the first surface 30 faces away from the modular attachment grid 100 and the second surface 31 faces modular attachment grid 100. The first side 32 includes the plurality of first straps 12 extending outward from the first side 32 of the base 10. The second side 34 includes the plurality of second straps 14 extending outward from the second side 34 of the base 10.

Figure 4:
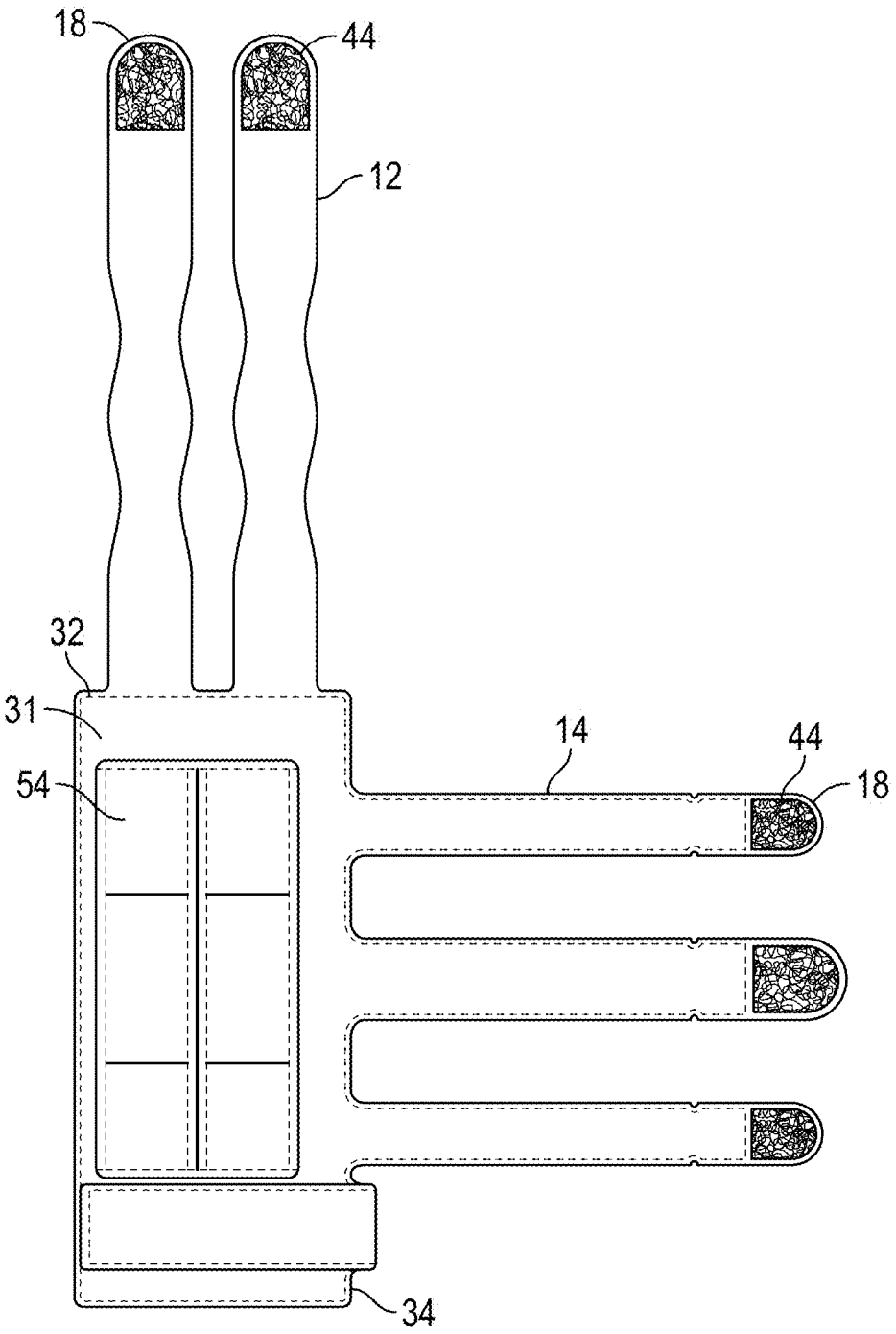
FIG. 4 is a perspective view of the attachment flaps of the attachment panel of FIG. 1.

The attachment ends 18 of each of the plurality of first straps 12 and the plurality of second straps 14 include a loop portion 44 (shown in FIG. 4). The base may also include a plurality of hook portions 46 configured to receive respective loop portions 44 to fix the plurality of first and second straps 12,14 onto the base 10. As such, the plurality of first and second straps 12,14 may be inserted through the modular attachment grid 100 to join the attachment panel 1 to an attachment surface 102 (shown in FIG. 2). The plurality of first straps 12 configured to attach the attachment panel 1 to the modular attachment grid 100 in the first configuration. The plurality of second straps 14 configured to attach the attachment panel 1 to the modular attachment grid in the second configuration. It should be understood that in different examples, the hook portions and loop portions could be interchanged with each other to achieve the same connectivity.

As will be described in greater detail below, the object retention arrangement 16 is configured to hold objects on the first surface and/or second surface of the attachment panel 1. In some examples, the object retention arrangement 16 includes retaining loops, slits, or a combination of the retaining loops and slits. Retaining loops may be a fabric configured to expand and contract with the insertion and removal of objects. In other examples, the object retention arrangement 16 may be pouches. As an example, pouches or retaining loops may be sewn or attached to the base 10 to allow retention of objects or tools to the attachment panel 1.

In the example attachment panel 1, the plurality of first straps 12 have at least two straps. The plurality of second straps 14 have at least three or more straps. A length L1 of the first side 32 is shorter than a length L2 of the second side 34. The plurality of first straps 12 are longer than the plurality of second straps 14 such that both can wrap around the base. It is understood more or less of the plurality of first or second straps 12,14 may be utilized to fix the panel to the modular attachment grid 100. Further, the straps 12,14 may have different shapes which may assist in attachment or insertion of the straps to the modular attachment grid 100. For instance, the plurality of first and second straps 12,14 may be wave shaped along a length of the strap. As such, the length of the plurality of first and second straps 12,14 may have both convex and concave regions. In other instances, the plurality of first and second straps 12,14 may be straight.

Figure 2:
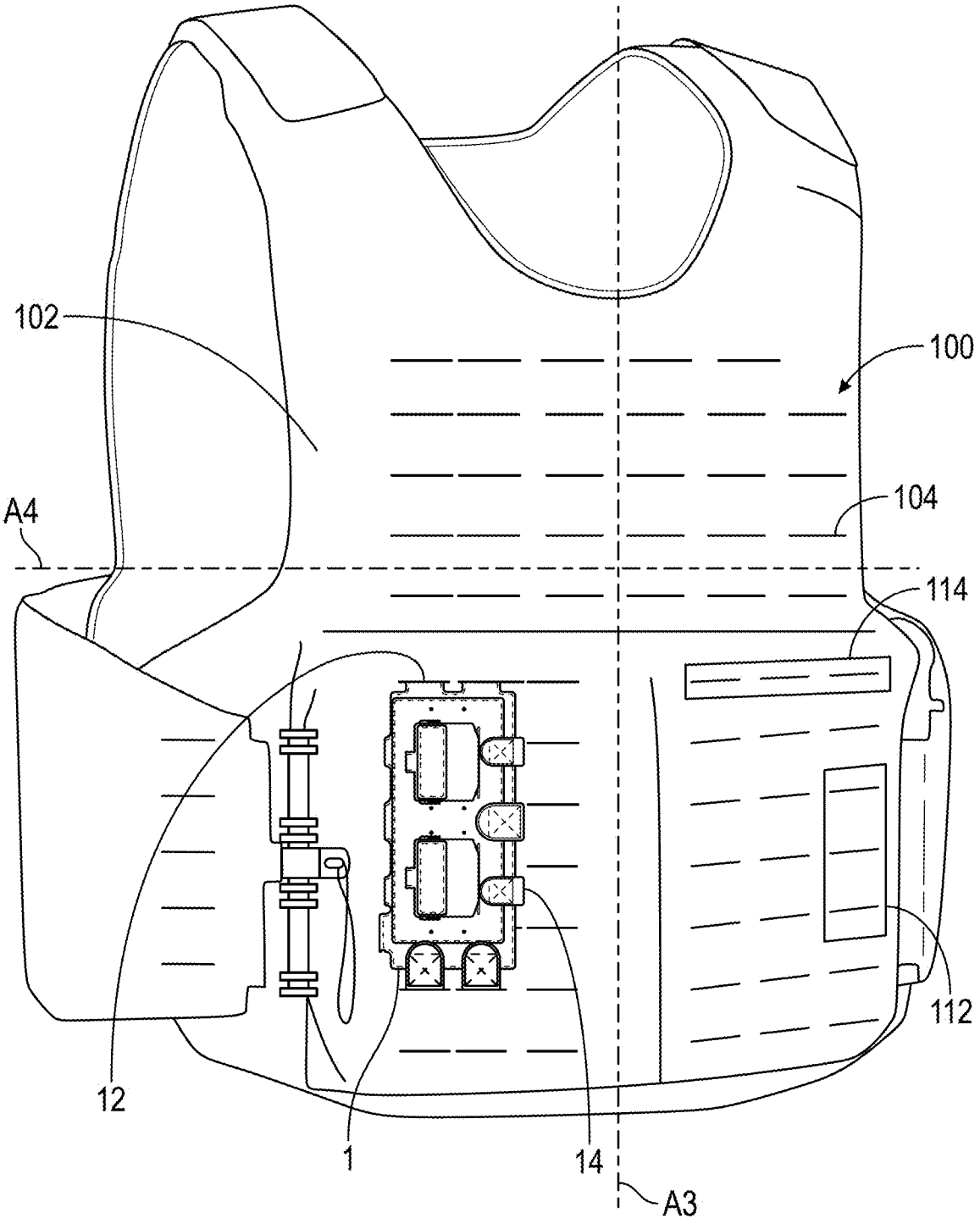
FIG. 2 is a perspective view of the attachment panel of FIG. 1 joined to the modular attachment grid in a first configuration.

FIG. 2 illustrates a modular attachment grid 100 configured to receive the attachment panel 1. The modular attachment grid 100 may be part of an attachment surface 102 which includes apertures 104 longitudinally spaced apart in vertical rows 112 and horizontal rows 114 to form a grid configuration on the attachment surface 102. As an example, the attachment surface 102 may be a vest, chest rig, belts, backpack or other load bearing equipment.

The apertures 104 define a path for the plurality of first and second straps 12,14. The apertures 104 are configured to receive one of the plurality of first straps 12 or the plurality of second straps 14. The straps 12,14 may extend in a longitudinal direction substantially parallel to a first attachment surface axis A3. The first attachment surface axis A3 can be a vertical axis. The modular attachment grid 100 also includes a second attachment surface axis A4 being a horizontal axis perpendicular to the first attachment surface axis A3. One of either the plurality of first or the plurality of second straps 12,14 may be inserted through one or more of the apertures 104 to be inserted through the modular attachment grid 100 and back through different apertures 104 to attach the loop portions 44 on hook portions 46 of the attachment panel 1.

While straps 12,14 are shown received in the apertures 104, the modular attachment grid 100 may be configured to receive straps, buckles, or clips. The attachment panel 1 may also be configured to have buckles or clips instead of hook and loop portions. In some examples, the attachment panel 1 may be part of a modular attachment apparatus including the attachment panel 1 the modular attachment grid 100 and the attachment surface 102.

Referring to FIGS. 2, the attachment panel 1 may be attached to the modular attachment grid 100 in either a first or second configuration. As shown in FIG. 2, the example attachment panel 1 can be positioned in the first configuration with the first surface 30 facing away from the modular attachment grid 100. The first configuration may be referred to as a vertical configuration. The plurality of first straps 12 are inserted through the apertures 104 and attach the attachment panel 1 to the modular attachment grid 100 in the vertical configuration. The vertical configuration may refer to a length L2 (shown in FIG. 1) of the second side 34 extending substantially parallel to the first attachment surface axis A3. In the first configuration, the plurality of second straps 14 are not inserted through the apertures 104. Instead, the second straps 14 are wrapped between the installed first straps 12 and the second surface 31 to attach to the base 10.

Figure 3:
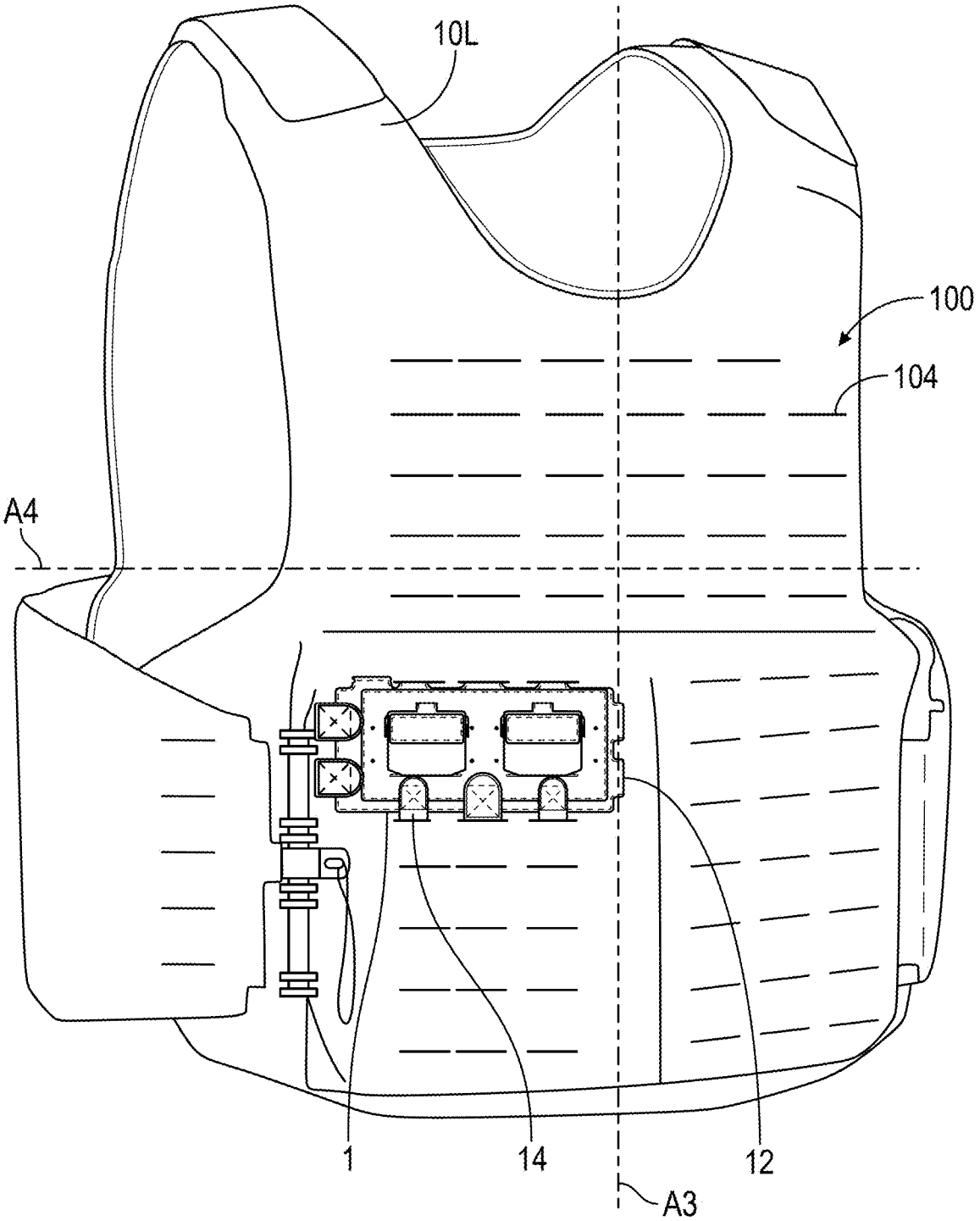
FIG. 3 is a perspective view of the attachment panel joined to the modular attachment grid in a second configuration.

As shown in FIG. 3, the example attachment panel 1 can be positioned in a second configuration with the first surface 30 facing away from the modular attachment grid 100. The second configuration may be referred to as a horizontal configuration. The plurality of second straps 14 are inserted through the apertures 104 and attaching the panel to the modular attachment grid 100 in a horizontal configuration. The horizontal configuration may refer the length L2 (shown in FIG. 1) of the second side 34 extending substantially parallel to the second attachment surface axis A4. In the second configuration, the plurality of first straps 12 are not inserted through the apertures 104. Instead, the first straps 12 are wrapped between the installed second straps 14 and the second surface 31 to attach to the base 10.

Referring back FIG. 1, the example attachment panel 1 includes the object retention arrangement 16. The example object retention arrangement 16 may include a fabric layer 50, a plurality of paired flap slits 52, a plurality of retaining loops 54, and attachment flaps 56. The fabric layer 50 joined to base 10 on the first surface 30. Each set of paired flap slits 52 are positioned on the fabric layer 50 of the first surface 230 of the base 10. Each set of paired of flap slits 52 create a path 53 between the fabric layer 50 and the base 10. The paired flap slits 52 allows the attachment flaps 56 to be inserted through one slit of the paired flap slits 52 and exit the other slit of the paired flap slits 52. The attachment flaps 56 includes a first end 58, a second end 62 and a central portion 60 between the first and second ends 58,62. The first and second ends 58,62 are configured to be compressed or folded to fit through the slits 52. After either one of the first or second ends 58,62 of the attachment flap 56 is inserted through, the central portion 60 of the attachment flap 56 is maintained in the path 53 between the slits 52, and the attachment flap 56 is secured to the attachment panel 1.

Each retaining loops 54 may include an opening for receiving objects (i.e., shotshells). The retaining loops 54 may be sewn to a position between the paired flap slits 52. The attachment flaps 56 are configured to form pouches or lids for holding objects or assist in securing objects within other retention means. As a non-limiting example, the attachment flaps 56 may be folded into a closed position around retaining loops 54 on the attachment panel 1 to assist in securing shotshells within respective retaining loops 54. The first and second ends 58,62 of the attachment flaps 56 may be configured to allow each attachment flap 56 to fold into a closed position and form a lid over the retaining loops 54. The first ends 58 may have a loop portion 64 foldable to engage a hook portion 66 on the second end 62. As such, an attachment flap 56 may be folded around respective paired slits 52 to form lids over openings of the retaining loops 54.

Figure 5:
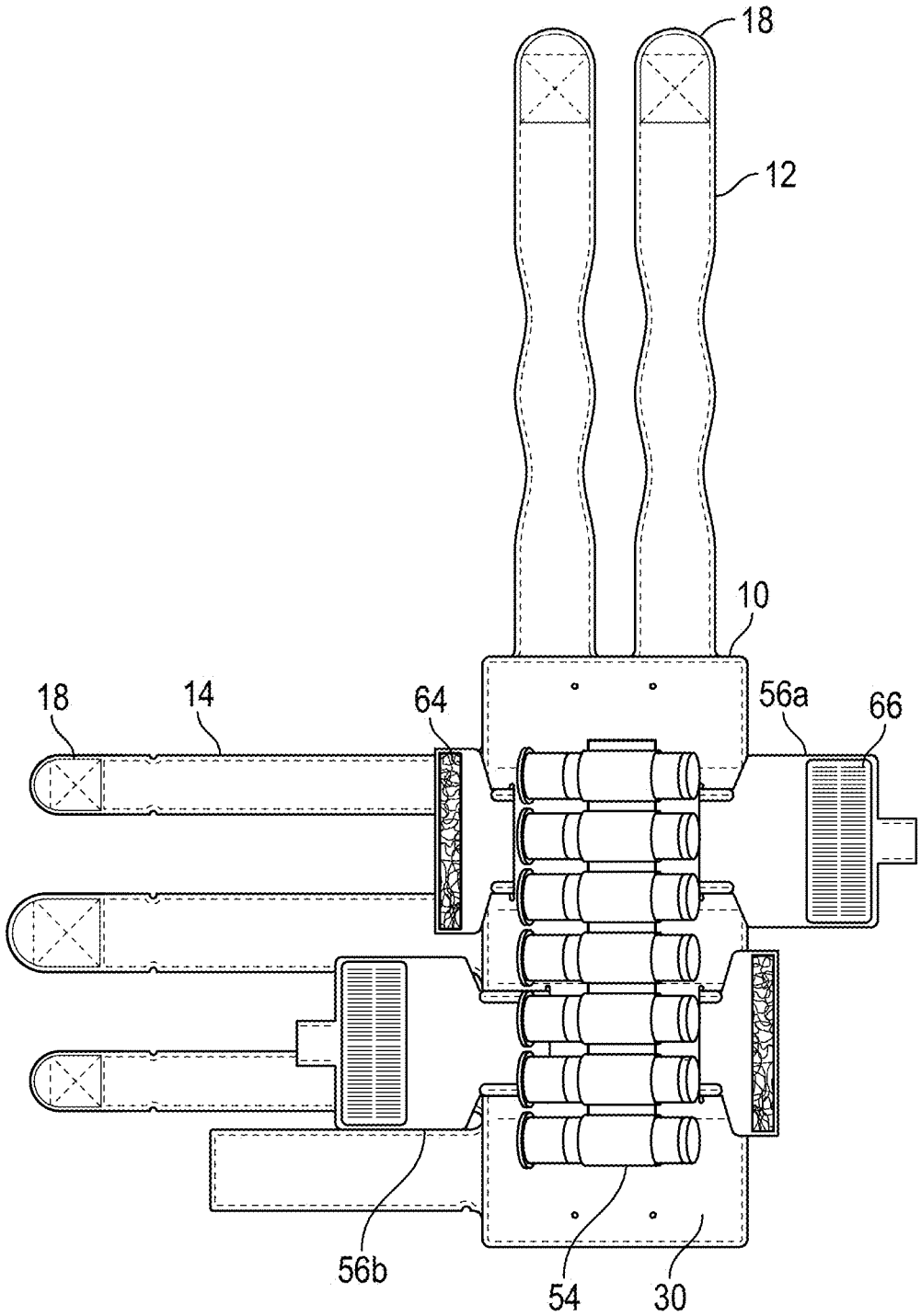
FIG. 5 is a back view of the attachment panel of FIG. 1.

Referring to FIG. 5, the attachment flaps 56 are configured to be received by the slits 52 in a first flap configuration and/or a second flap configuration. The attachment flap 56 may be in a second flap configuration which is reverse relative to the first flap configuration within the path 53 (shown best in FIG. 1). In the example attachment panel 1 of FIG. 5, the attachment flap 56*a* is shown in the first flap configuration and the attachment flap 56*b* is shown in the second flap configuration. In the first configuration, the first end 58 of the attachment flap 56*a* may be inserted through the paired flap slits 52 with the loop portions 64 adjacent the second side and in the second configuration the first end 58 of the attachment flap 56*b* may be inserted through the paired flap slits 52 with the hook portion 66 adjacent the second side 34. As such, a user may reverse the orientation of the loop portions 64 when switching the attachment flaps 56 between the first or second flap configurations. It should be understood that any attachment flaps 56 may be inserted into the slits 52 in either first or second flap configurations as desired.

Referring to FIGS. 1, 4, and 5, the attachment panel 1 may further include a plurality of retaining loops 54. The plurality of retaining loops 54 are configured to hold objects on the first surface 30 of the base 10. Preferably, the plurality of retaining loops 54 includes at least six loops; however, more or less loops may be used. The plurality of retaining loops 54 may be positioned on the fabric layer 50 between the slits 52. Advantageously the attachment flaps 56 provide an additional method of securing objects within the retaining loops 54. In some instances, retaining loops 54 may be positioned in a linear configuration. In other instances, the retaining loops 54 may be arranged in rows. Referring to FIG. 4, in some examples, retaining loops 54 may also be positioned on the second surface 31 of the base 10 opposite the first surface 30 including the slits 52.

Figure 6:
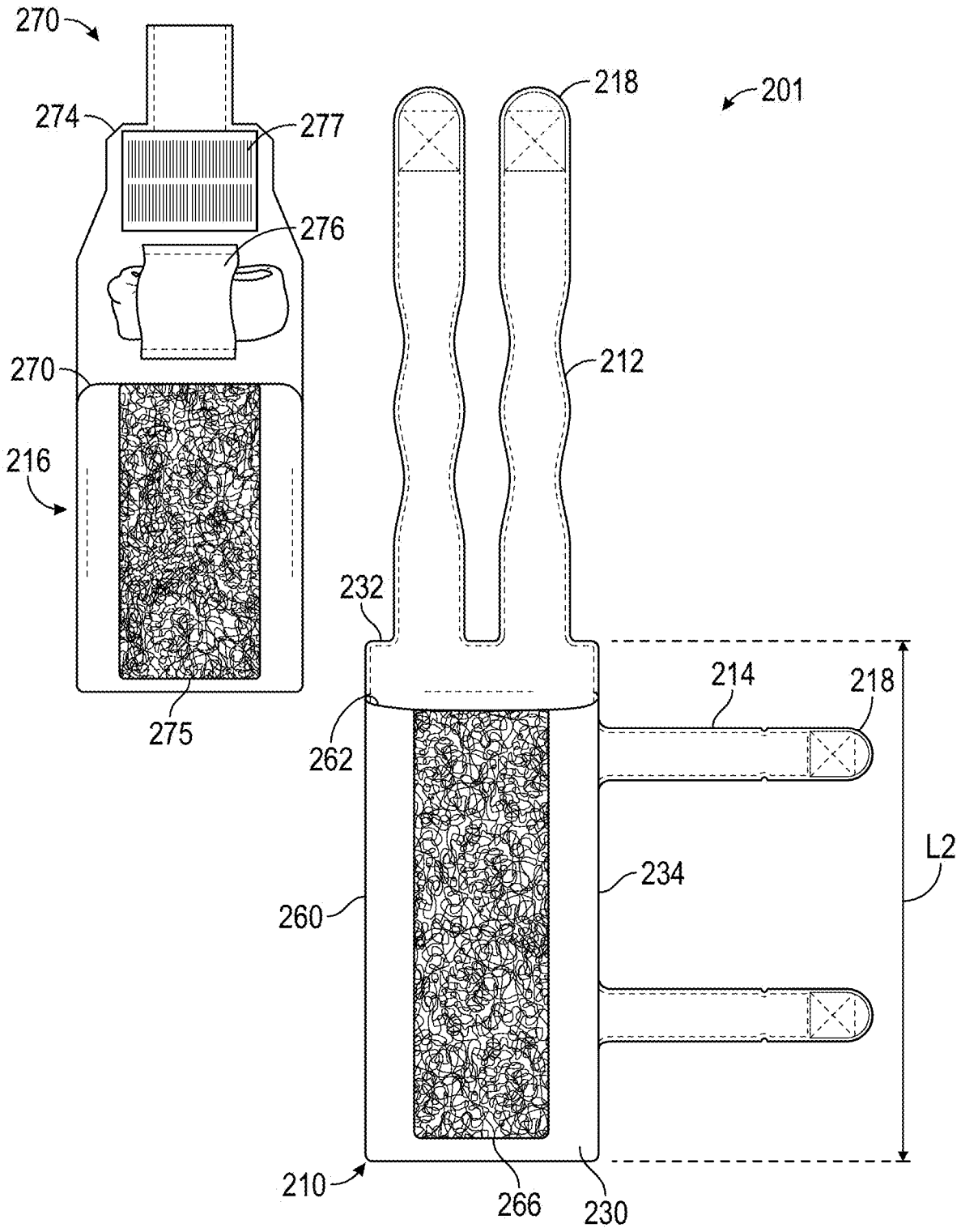
FIG. 6 is an exploded front perspective view of another embodiment of the attachment panel of the present disclosure.
Figure 7:
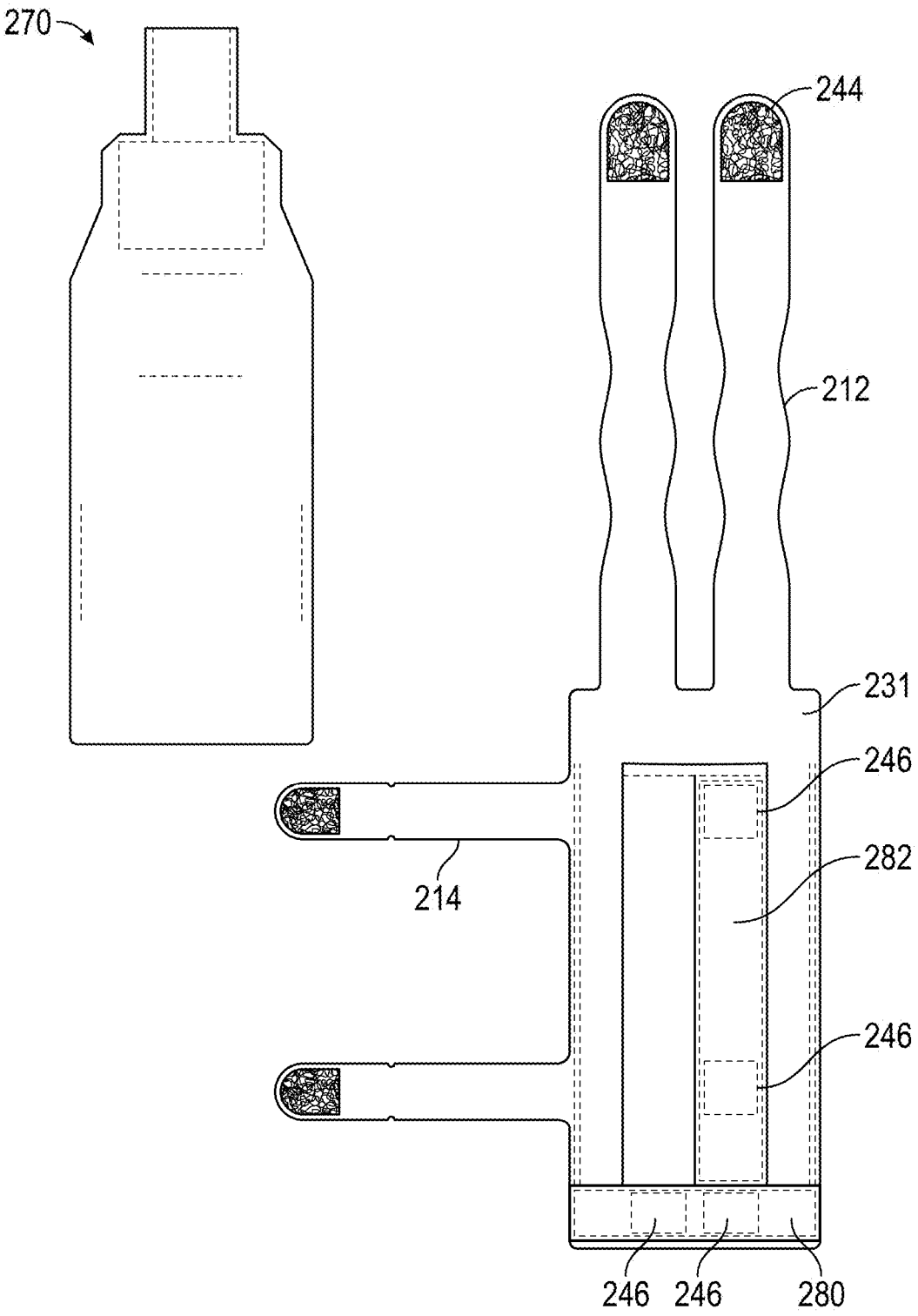
FIG. 7 is an exploded back perspective view of the attachment panel of FIG. 6.

FIGS. 6 and 7 illustrate an alternative embodiment of the attachment panel 201 of the present disclosure. As shown, a base 200 includes a first surface 230, a second surface 231, a first side 232, a second side 234, a plurality of first straps 212, a plurality of second straps 214, and an object retention arrangement 216.

The plurality of first straps 212 may include two straps. The plurality of second straps 214 may include two straps which are shorter than the first straps 212. The plurality of first straps 212 extend from the first side 232. The plurality of second straps 214 extend from the second side 234. Each of the plurality of first and second straps 212,214 have an attachment end 218 with a loop portion 244. The attachment ends 218 of the plurality of first and second straps 212,214 may be attached to hook portions 246 (shown in FIG. 7) on a second surface 231 of the base 210.

A second side 234 of the base 10 may include a first strip 280 and at least one second strip 282. when the first straps 212 are attached to the base 10, the first strip 280 configured to the surround the attachment end 218 of plurality of first straps 212. When the second straps 214 are attached to the base 10, the at least one second strip 282 is configured to surround the attachment end 218 of the plurality of second straps 214 A plurality of hook portions 246 may be positioned between the second surface 231 and the first strip 280, and between the second surface 231 and the at least one second strip 282. When the loop portions 244 of the plurality of first and second straps 212,214 are engaged to the hook portions 246, the strips 280,282 help secure the straps 212,214 and mitigate friction or other forces from undesirably disengaging the plurality of first and second straps 212,214. In other examples, the hook portions 246 may be positioned on the first surface 230.

The object retention arrangement 216 may be a first pouch 260 on the first surface 230 of the base 210. The first pouch 260 may include an opening 262. The first pouch 260 may be integrally formed with the base 210 with the opening 262 positioned adjacent the first surface 230 of the base 210. The first pouch 260 includes a loop portion 266 configured to allow the removable pouch 270 to attach to the first pouch 260. When attached to the modular attachment grid 100, the first surface 230 and the first pouch 260 face away from the modular attachment grid 100.

The first pouch 260 is configured to receive a removable pouch 270 or other objects within the opening 262. The removable pouch 270 is configured to receive objects or tools. For instance, in some cases, the removable pouch 270 may hold a medical kit. The object retention arrangement 216 further including the removable pouch 270.

In the first configuration, the plurality of first straps 212 are inserted through the apertures 104 to place the panel in a vertical configuration. In the second configuration, the plurality of second straps 14 may be inserted through the apertures to place the panel in a horizontal configuration.

For instance, the example attachment panel 201 can be positioned in the first configuration which allows the attachment panel 201 to be joined to the modular attachment grid 100 with the opening 262 of the first pouch 260 in a vertical configuration with the length L2 of the second side 234 the base 210 being substantially parallel with the first attachment surface axis A3 of the modular attachment grid 100. Alternatively, the example attachment panel 1 can be positioned in the second configuration which allows the attachment panel 201 to be joined to the modular attachment grid 100 with the opening 262 of the first pouch 260 in a horizontal configuration. In the second configuration with the length of the second side 234 substantially parallel with the second attachment surface axis A4 of the modular attachment grid 100.

Referring to FIG. 6, the removable pouch includes a flap 274 for closing an opening 272. The flap 274 may be closed by a similar hook and loop configuration. A hook portion 277 may be positioned on the flap 274. An exterior of the removable pouch 270 may include a hook portion 275 which can allow the flap 274 to close the opening 272. Alternatively, when the removable pouch 270 is received in the first pouch 260, the hook portion 277 may be engaged with the loop portion 266 to attach the removable pouch 270 to the first pouch 260. Attaching the hook portion 277 to the loop portion 275 closes the opening 272 of the removable pouch. The interior side of the flap 274 may further include a retaining loop 276 for holding an object. The interior of the removable pouch 270 also configured to hold an object. In the example removable pouch 270, the object is a medical kit. Advantageously, the first pouch 260 and the removable pouch 270 together provide two levels of securing the pouch to a modular attachment grid 100. It should be understood that in different examples, the hook portions and loop portions described in the present disclosure could be interchanged with each other to achieve the same connectivity.

Although various embodiments are described herein, those of ordinary skill in the art will understand that many modifications may be made thereto within the scope of the present disclosure. Accordingly, it is not intended that the scope of the disclosure in any way be limited by the examples provided.

What is claimed:

1. An attachment panel receivable by a modular attachment grid, comprising:

a base defining a first surface and a second surface;

a plurality of first straps on a first side of the attachment panel;

a plurality of second straps on a second side of the attachment panel; and an object retention arrangement configured to hold objects on the first surface of the attachment panel;

wherein each of the plurality of first straps and the plurality of second straps include an attachment end to attach the attachment panel to the modular attachment grid in either a first configuration or second configuration, wherein in the first configuration, the attachment panel is positioned in a vertical configuration on the modular attachment grid, and wherein in the second configuration, the attachment panel is positioned in a horizontal configuration on the modular attachment grid, wherein the base includes a plurality of paired flap slits, wherein each of the plurality of paired flap slits is configured to receive attachment flaps, the attachment flaps foldable to a closed position, and wherein each attachment flap including a first end with a loop portion and a second end with a hook portion, and wherein each of the attachment flaps are configured to be received in a first flap configuration or a second flap configuration, wherein in the first configuration the first end of the attachment flaps are inserted through the paired flap slits with the loop portion adjacent the second side, and wherein in the second configuration, the first end of the attachment flaps are inserted through the paired flap slits with the hook portion adjacent the second side.

2. The attachment panel of claim 1, wherein in the first configuration, the plurality of first straps are inserted into apertures of the modular attachment grid, and wherein in the second configuration, the plurality of second straps are inserted into the apertures of the modular attachment grid.

3. The attachment panel of claim 1, wherein in the vertical configuration a length of the second side extends parallel to a first attachment surface axis, wherein in the horizontal configuration the length of the second side extends parallel to a second attachment surface axis, and the first side is shorter in length than then second side.

4. The attachment panel of claim 1, wherein the attachment panel further includes a plurality of retaining loops configured to hold objects on the first surface, the plurality of retaining loops positioned between the paired flap slits, and wherein the attachment flaps are configured to fold to the closed position over the plurality of retaining loops.

5. The attachment panel of claim 4, wherein the second surface of the base includes a plurality of retaining loops configured to hold objects on the second surface.

6. The attachment panel of claim 2, wherein the base includes a first pouch on the first surface facing away from the modular attachment grid, wherein the first pouch includes an opening adjacent the first side of the base, wherein the first pouch is configured to receive a removable pouch within the opening.

7. The attachment panel of claim 6, wherein the first pouch further includes a loop portion, wherein the removable pouch has a flap with a hook portion, and wherein the hook portion of the removable pouch is engageable with the loop portion of the first pouch to attach the removable pouch to the first pouch.

8. An apparatus comprising:

an attachment surface comprising a modular attachment grid; and an attachment panel is configured to be received by the modular attachment grid, the attachment panel comprising:

a base defining a first surface and a second surface;

a plurality of first straps on a first side of the attachment panel;

a plurality of second straps on a second side of the attachment panel; and an object retention arrangement configured to hold objects on the first surface of the attachment panel; and wherein each of the plurality of first straps and the plurality of second straps include an attachment end to attach the attachment panel to the modular attachment grid in either a first configuration or second configuration, wherein in the first configuration the attachment panel is positioned in a vertical configuration on the modular attachment grid, and wherein in the second configuration the attachment panel is positioned in a horizontal configuration on the modular attachment grid, wherein the base includes a plurality of paired flap slits, wherein each of the plurality of paired flap slits is configured to receive attachment flaps, the attachment flaps foldable to a closed position, and wherein each attachment flap including a first end with a loop portion and a second end with a hook portion, and wherein each of the attachment flaps are configured to be received in a first flap configuration or a second flap configuration, wherein in the first configuration the first end of the attachment flaps are inserted through the paired flap slits with the loop portion adjacent the second side, and wherein in the second configuration, the first end of the attachment flaps are inserted through the paired flap slits with the hook portion adjacent the second side.

9. The apparatus of claim 8, wherein in the first configuration the plurality of first straps are inserted into apertures of the modular attachment grid, and wherein in the second configuration the plurality of second straps are inserted into the apertures of the modular attachment grid.

10. The apparatus of claim 8, wherein in the vertical configuration a length of the second side extends parallel to a first attachment surface axis, wherein in the horizontal configuration the length of the second side extends parallel to a second attachment surface axis, and the first side is shorter in length than then second side.

11. The apparatus of claim 8, wherein the attachment panel further includes a plurality of retaining loops configured to hold objects on the first surface, the plurality of retaining loops positioned between the paired flap slits, and wherein the attachment flaps are configured to fold to the closed position over the plurality of retaining loops.

12. The apparatus of claim 11, wherein the second surface of the base includes a plurality of retaining loops configured to hold objects on the second surface.

13. The apparatus of claim 9, wherein the base includes a first pouch on the first surface facing away from the modular attachment grid, wherein the first pouch includes an opening adjacent the first side of the base, wherein the first pouch is configured to receive a removable pouch within the opening.

14. The apparatus of claim 13, wherein the first pouch further includes a loop portion, wherein the removable pouch has a flap with a hook portion, and wherein the hook portion of the removable pouch is engageable with the loop portion of the first pouch to attach the removable pouch to the first pouch.

* * * * *